US005771752A

United States Patent [19]

Cicotte

[11] Patent Number: 5,771,752

[45] **Date of Patent: *Jun. 30, 1998**

[54] ADJUSTABLE AUTOMOBILE PEDAL SYSTEM

[76] Inventor: Edmond B. Cicotte, 11086 Hedgeway, Utica, Mich. 48317

[ * ] Notice: The term of this patent shall not extend beyond the expiration date of Pat. No. 5,351,573.

[21] Appl. No.: 730,573

[22] Filed: Oct. 15, 1996

Related U.S. Application Data

[63] Continuation of Ser. No. 266,937, Aug. 16, 1994, abandoned, which is a continuation-in-part of Ser. No. 772,326, Oct. 7, 1991, Pat. No. 5,351,573.

[51] Int. Cl.[6] ..... G05G 1/14

[52] U.S. Cl. ..... 74/512; 74/518; 74/513; 74/560

[58] Field of Search ..... 74/512, 513, 560, 74/561, 562, 522, 525; 29/434

[56] References Cited

U.S. PATENT DOCUMENTS

| | | | |
|---|---|---|---|
| 2,550,731 | 5/1951 | Tack . | |
| 2,550,732 | 5/1951 | Tack et al. . | |
| 2,860,720 | 11/1958 | Huff et al. . | |
| 3,151,499 | 10/1964 | Roe . | |
| 3,282,125 | 11/1966 | Dully . | |
| 3,301,088 | 1/1967 | White . | |
| 3,400,607 | 9/1968 | Smith . | |
| 3,563,111 | 2/1971 | Zeigler . | |
| 3,643,525 | 2/1972 | Gibas . | |
| 3,646,831 | 3/1972 | Janosi | 74/518 |
| 3,678,779 | 7/1972 | Janosi | 74/516 |
| 3,765,264 | 10/1973 | Bruhn, Jr. . | |
| 3,798,995 | 3/1974 | Schroter . | |
| 4,386,537 | 6/1983 | Lewis | 74/512 |
| 4,683,977 | 8/1987 | Salmon . | |
| 4,870,871 | 10/1989 | Ivan . | |
| 4,875,385 | 10/1989 | Sitrin . | |
| 4,989,474 | 2/1991 | Cicotte et al. . | |
| 5,010,782 | 4/1991 | Asano et al. . | |

FOREIGN PATENT DOCUMENTS

| | | | |
|---|---|---|---|
| 0492873 | 7/1992 | European Pat. Off. | 74/512 |
| 2841988 | 4/1980 | Germany | 74/512 |
| 3904616 | 8/1989 | Germany | 74/512 |
| 58-47923 | 9/1981 | Japan . | |
| 63-270267 | 11/1988 | Japan | 74/512 |
| 2-68257 | 3/1990 | Japan | 74/528 |
| 4-219562 | 8/1992 | Japan | 74/523 |
| 5-185912 | 7/1993 | Japan | 74/512 |
| 952831 | 3/1964 | United Kingdom . | |

*Primary Examiner*—Vinh T. Luong
*Attorney, Agent, or Firm*—Vanophem Meehan & Vanophem, P.C.

[57] ABSTRACT

An adjustment device for an automobile control pedal which is capable of pivotably adjusting the control pedal relative to a reaction member, such as the eyelet of a cylinder pushrod for a brake pedal or a flexible cable in case of an accelerator pedal. The adjustment device allows the control pedal to be positioned to suit the needs of a particular driver. The control pedal can be pivotably attached to a frame in any conventional manner, such as with a pivot pin. The adjustment device is mounted alongside the control pedal and to the pushrod eyelet without the need of additional support hardware other than a device for acting on the control pedal. The adjustment device includes a rotatable member for causing pivotable movement of the pedal arm relative to the reaction member. The adjustment device is maintained a predetermined distance from the pivot of the control pedal arm by a spacing device, such as a link. The adjustment device also includes a rotatable driving device for rotating about its axis of rotation to produce a corresponding displacement of the control pedal arm.

41 Claims, 5 Drawing Sheets

ADJUSTABLE AUTOMOBILE PEDAL SYSTEM

CROSS REFERENCE TO RELATED APPLICATIONS

This is a continuation of application Ser. No. 08/266,937, filed Aug. 16, 1994, now abandoned, which is a continuation-in-part application to U.S. application Ser. No. 07/772,326, now U.S. Pat. No. 5,351,573 issued on Oct. 4, 1994.

BACKGROUND OF THE INVENTION

1. Field of the Invention

The present invention generally relates to automobile control pedals, such as brake, clutch and accelerator pedals. More specifically, this invention relates to an adjustable automobile control pedal system whose pedals can be selectively adjusted to allow optimal positioning of the pedals relative to the driver of the automobile.

2. Description of the Prior Art

Automobiles are conventionally provided with foot-operated control pedals, such as an accelerator, brake and clutch pedal, which are used to control the motion and speed of the automobile. Typically, these control pedals are permanently fixed to the vehicle chassis and rotate away from the driver when foot pressure is applied, and are not adjustable relative to the driver or their respective attachment points. Consequently, the control pedals must generally be attached so as to be positioned relative to the floor of the passenger compartment to afford operation which is adequately comfortable for the "average" driver. However, some adjustment of the driver relative to the control pedals is clearly desirable.

Though the driver's seat is usually mounted so as to be slidable in a fore and aft direction to accommodate drivers of different physiques, such an arrangement is only partially effective in positioning the driver relative to the control pedals. Seat adjustment allows the driver to position himself or herself relative to the automobile's steering wheel and the control pedals, to some degree improving the driver's comfort and facilitating the driver's ability to operate the vehicle's primary controls. However, it is nearly impossible for such a solution to accommodate all possible variations in the human frame. In particular, proportional differences between the lengths of a driver's arms, legs and feet in relation to the driver's overall physique cannot be readily accommodated by merely adjusting the seat fore and aft with respect to the control pedals. Accordingly, it has been recognized that some form of control pedal adjustment is desirable to provide optimal comfort to the driver while also ensuring that the driver can fully operate the control pedals at all times.

Lever mechanisms, of course, are known in the prior art. The adjustment of one lever with respect to another concentrically mounted lever can also be found in wear or slack adjuster mechanisms. For example, Tack, U.S. Pat. No. 2,550,731 and Tack et al, U.S. Pat. No. 2,550,731, teach a manually operated screw mechanism threaded into one lever and operatively connected to associated hangers for adjusting the slack conditions in the brake rigging by adjusting with respect to the hangers and simultaneously modifying the position of the brake lever where it is connected to the associated brake rigging.

Many approaches to providing adjustable control pedals have been suggested in the prior art. One approach is to provide some form of ratchet device which allows the entire control pedal assembly to rotate about a primary pivot point. This approach rotates a frame to which the control pedals are each rotatably attached, thus providing rotation of the control pedals in unison relative to the driver. Examples of this approach are illustrated in U.S. Pat. Nos. 3,282,125 to Dully; 3,400,607 to Smith; and 3,563,111 to Zeigler. A similar approach is to mount one or more control pedals to a frame which is slidable fore and aft as a unit relative to the driver, as illustrated in U.S. Pat. Nos. 2,860,720 to Huff et al, 4,683,977 to Salmon, 5,010,782 to Asano et al, and British Patent No. 952,831 to Mussell. As taught by Asano et al, the entire frame and pedal assembly rotates about a single pivot point during actuation of the pedal. A disadvantage with pedal systems such as that of Asano et al is that a spring is required to return the pedal and frame assembly to its initial position, necessitating that the driver also overcome the force generated by the spring in order to actuate the pedal.

Yet another suggested approach is a variation on the two previously mentioned, employing a screw-actuated device to displace a frame to which one or more control pedals are rotatably mounted. The screw-actuated device can be used to either rotate the entire frame about a pivot point, as shown in U.S. Pat. Nos. 3,151,499 to Roe, or the screw-actuated device can displace the frame fore and aft, as illustrated by U.S. Pat. Nos. 3,301,088 to White; 3,643,525 to Gibas; 3,765,264 to Bruhn, Jr.; 4,870,871 to Ivan; 4,875,385 to Sitrin; and 4,989,474 as well as 5,078,024 to Cicotte et al. Typically, the screw-actuated device is disclosed to be driven by an eccentric motor which allows the control pedals to be selectively adjusted by the driver from an appropriate control switch mounted on the dashboard of the vehicle within the driver's reach.

As can be readily appreciated by those skilled in the art, the above examples all require substantial hardware and space beneath the automobile's instrument panel to accommodate the device providing the adjustment feature. Much of the necessary additional hardware can be attributed to the need to avoid effecting the operation of the brake and/or clutch pedals, during adjust, with their respective hydraulic cylinders. Specifically, the approach chosen must avoid causing the pushrods which actuate the respective cylinder pistons to be displaced relative to their cylinders so as to ensure non-engagement of the brakes and/or the clutch.

In addition, it is generally preferable that the approach chosen have no affect on the mechanical advantage of the control pedal as determined by the control pedal's orientation relative to the pushrod. Generally, the mechanical advantage of a control pedal can be described as the relative effort required to apply the control pedal as compared to the actual force required to actuate the device controlled by the control pedal. For instance, mechanical advantage can be improved by moving the contact point between the control pedal and the cylinder's pushrod toward the pivot point of the control pedal.

To avoid changing the mechanical advantage, the adjustable control pedal assemblies of the prior art generally teach a device in which the control pedals are independently adjusted so as to produce no adverse effect with respect to repositioning of the pedal pivot point relative to the pushrods of the respective operating cylinders, as can be seen with the teachings of Cicotte et al. Alternatively, the adjustment device must be provided with a mechanism which simultaneously adjusts the length of the pushrod to accommodate the displacement of the control pedal assembly, as seen with the teachings of Bruhn, Jr.

Though regarding an unrelated and non-analogous problem associated with optimizing the mechanical advantage of a control pedal, U.S. Pat. No. 3,798,995 to Schroter teaches the use of a variable-ratio control pedal utilizing a camming contour for amplifying the mechanical advantage of the control pedal in the latter stages of the control pedal stroke. The intent with such a device is to maximize the driver's braking capability without the need for excessive forces applied to the control pedal. However, the teachings of Schroter are directed entirely toward achieving an optimal mechanical advantage and do not provide any adjustment of the control pedals with respect to the driver. Further, Schroter does not teach or suggest a solution to the problem of adjusting the positions of the control pedals, nor does Schroter even recognize the problem to which the above prior art is directed.

From the above discussion, it can be readily appreciated that the prior art does not disclose an automobile control pedal arrangement which can be adjusted to adapt to the particular physiological requirements of a driver, while simultaneously avoiding the requirement of mounting the entire control pedal assembly to a frame which is either pivotable or displaceable relative to the driver. Nor does the prior art teach or suggest an apparatus which entails minimal additional hardware to achieve suitable adjustment of one or more control or accelerator pedals to the effect that no repositioning of the prior art pivot point locations is required and, therefore, no significant structural changes need be made to a conventional control pedal arrangement.

Accordingly, what is needed is a cost-efficient adjustment device for adjusting one or more automobile control and/or accelerator pedals, the adjustment device being capable of spatially adjusting the control pedals without repositioning the pivot attachment of the conventional control pedal arrangement to adapt to the physiological demands of a driver, while simultaneously requiring minimal structural reinforcements and modifications to achieve the desired results.

SUMMARY OF THE INVENTION

According to the present invention there is provided an adjustment device for one or more automobile control and/or accelerator pedals. The adjustment device is capable of causing pivotable adjustment, utilizing the conventional pivot point position of the control pedal to adjust one or more control pedals independently or in unison relative to a predetermined datum point. The datum point is preferably defined by a reaction member upon which the control pedal operates, such as the pivot eyelet of a master cylinder pushrod for a clutch or brake pedal, due to the need to leave the operation of the clutch and brake master cylinders unaltered during adjustment of the respective control pedals. For an accelerator pedal, the reaction member is typically a flexible cable by which the fuel system is operated. Because the accelerator pedal is typically pivotably mounted to the firewall for purposes of actuating the cable, the datum point may be any suitable reference point which allows conventional operation of the accelerator pedal with respect to the cable. Being adjustably pivotable in this manner, the control pedals can be optimally positioned to suit the needs of a particular driver.

Conventionally, each control pedal includes an arm which is pivotably attached to a frame member beneath the automobile's instrument panel by means of a pivot pin and bushing or the like. Where the control pedal is the brake or clutch pedal, the adjustment device of the present invention is mounted alongside the conventional control pedal arm and pivotally attached at the eyelet of the cylinder pushrod, without the need of any additional support hardware other than a device for maintaining a predetermined distance between the pushrod eyelet and the pivot attachment of the control pedal arm. Consequently, the adjustment device can be readily adapted to fit conventional control pedal assemblies without significant modification.

In one embodiment, the adjustment device includes a camming device, such as a disc-shaped cam having a predetermined camming contour. The automobile pedal arm slidably abuts the camming device such that rotation of the camming device about its axis of rotation causes pivotable movement of the automobile pedal arm relative to the pushrod eyelet. By example, where the control pedal is the brake pedal, the brake pedal arm is displaced relative to the brake master cylinder's pushrod eyelet by the camming device.

The camming device preferably has its axis of rotation substantially parallel to the control pedal arm's axis of rotation about its corresponding pivot. Furthermore, its axis of rotation may be coincident with or spaced from the axis of the pushrod eyelet. The axis of rotation of the camming device is maintained a predetermined distance from the pivot of the control pedal arm by a spacing device, such as a link. By maintaining this predetermined distance, the axes of the camming device and the pushrod eyelet are properly maintained relative to the control pedal arm to maintain a preferred constant mechanical advantage for the control pedal arm.

The adjuster device also includes a cam driving device for rotating the camming device about its axis of rotation. When the driving device causes the camming device to rotate, the camming contour of the camming device produces a corresponding displacement of the control pedal arm relative to the pushrod eyelet. Thus, the control pedal arm is rotated about its pivot point, and thereby can be selectively adjusted relative to the driver of the automobile. As noted above, the link prevents any change in the spatial positioning of the pushrod eyelet to the pivot point of the control pedal arm, preventing any change in the mechanical advantage of the control pedal. Further, there is no change in the position of the pushrod relative to the pushrod's corresponding cylinder to produce a partial application of the device which the control pedal operates.

According to a further embodiment of this invention, one end of the link is mounted directly to the eyelet of the pushrod, while the opposite end of the link is mounted to the control pedal arm's pivot point so as to be alongside the control pedal arm. In addition, the cam driving device and the camming device are mounted directly to the link or the control pedal arm. With this construction and arrangement, minimal additional hardware is necessary to implement the adjustment device of the present invention on conventional automobile control pedal assemblies. Consequently, little additional space is required to fit the hardware associated with the adjustment device in the conventional mounting space of the vehicle.

In addition, no independent adjustment is necessary to maintain the position of the cylinder pushrod relative to its cylinder in that the adjustment device of the present invention provides control pedal adjustment with respect to the cylinder pushrod and does not require any relocation or cause any movement of the cylinder pushrod itself. The cylinder pushrod provides a stationary datum point throughout the adjustment of the control pedal, with mechanical contact between the camming device and the control pedal arm being maintained such that the control pedal is displaced with respect to the cylinder pushrod. Accordingly, the operation of the pushrod with its cylinder is not affected by the adjustment device of the present invention. Moreover, no change in the mechanical advantage of the control pedal arm results. Similarly, the operation of the accelerator cable is not affected by the adjustment device of the present invention, in that, the invention as disclosed displaces the pedal arm of the accelerator with respect to the attachment point of the accelerator cable.

In addition, a significant advantage of the present invention is that the cam driving device can be electrically driven by a suitable motor to allow control pedal positioning with one or more controls made accessible on the automobile's instrument panel. With suitable control circuitry, several positions can be placed into a memory device such that a driver can preset an optimal control pedal position for his or her particular frame, allowing automatic recall of the memorized position.

In a further embodiment of the invention, the functions of the cam rotation device may be obtained by a power screw which can be rotated by a manual adjuster mechanism or electrical driven actuator in order to displace the control pedal arm with respect to the cylinder pushrod without any movement of the cylinder pushrod itself.

Accordingly, it is an object of the present invention to provide an adjustment device for one or more automobile control pedals which is capable of optimally positioning the control pedals and/or accelerator pedal relative to the driver.

It is a further object of the invention that the adjustment device provide pivotable adjustment of the automobile control or accelerator pedal relative to a predetermined fixed datum, such as the pushrod eyelet of the hydraulic cylinder operated by the control pedal or an accelerator cable operated by an accelerator pedal.

It is still a further object of the invention that an embodiment of the adjustment device include a camming device which pivotably rotates the control pedal relative to the predetermined datum to achieve the desired adjustment.

It is another object of the invention that the camming device be positionally maintained relative to the control pedal arm during adjustment so as to maintain a preferred mechanical advantage.

It is yet another object of the invention that the camming device be electrically driven so as to allow the control pedal to be adjusted from a control device which is readily accessible to the driver.

It is also another object of the invention to utilize a power screw which may be rotated by a manual or electrically driven adjuster mechanism in order to displace the control pedal arm or accelerator pedal arm with respect to the cylinder pushrod or accelerator cable without any movement of either the cylinder pushrod and/or the accelerator cable.

It is still another object of the invention that the adjustment device require minimal additional hardware so as to minimize the structural modifications required to adapt the adjustment device to a conventional automobile control pedal arm.

Other objects and advantages of this invention will be more apparent after a reading of the following detailed description taken in conjunction with the drawings provided.

DETAILED DESCRIPTION OF THE PREFERRED EMBODIMENT

Figure 1A:
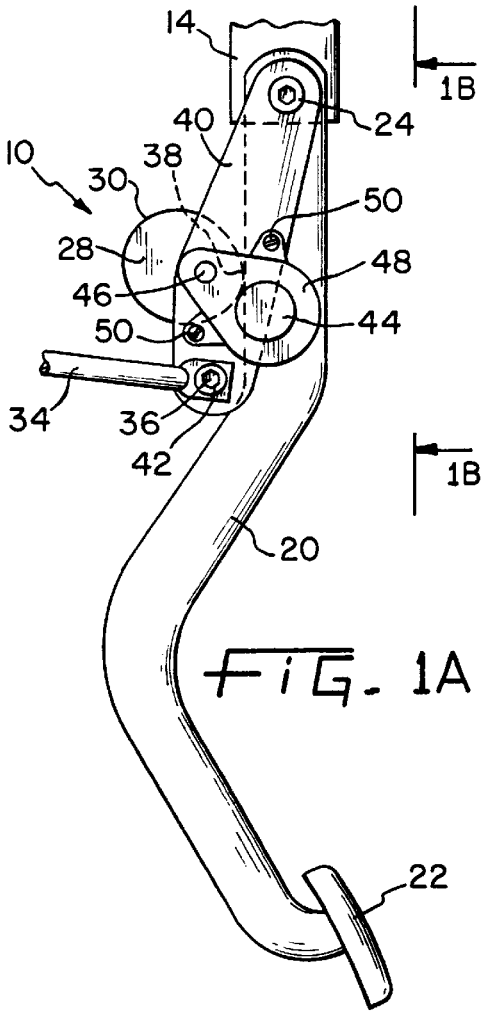
FIG. 1A is a side view of an automobile control pedal unit provided with an adjustment device in accordance with a first embodiment of this invention.
Figure 1B:
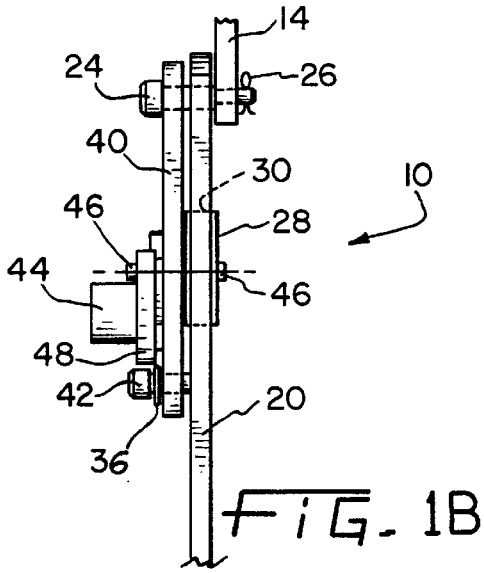
FIG. 1B is a view of FIG. 1A in the direction of arrows 1B—1B of FIG. 1A.

With reference to FIGS. 1A and 1B, there is shown an automobile control pedal assembly 10 in accordance with a first embodiment of this invention. As illustrated, the automobile control pedal assembly 10 represents a brake or clutch control pedal for actuating a master cylinder (not shown) located within the engine compartment of an automobile. The following descriptions pertaining to FIGS. 1A through 4B will each refer to the use of the present invention within the environment of a brake or clutch control pedal. FIGS. 5A through 6B illustrate the teachings of the present invention as adapted for use with an automobile's accelerator control pedal 60.

Conventionally, the control pedal assembly 10 illustrated in FIGS. 1A and 1B is suspended just above the compartment floor on the driver's side of the automobile. The control pedal assembly 10 is initially spaced a nominal distance from the driver's seat so as to be operable by a driver having an "average" physique. Typically, a driver's seat is adjustable fore and aft so as to bring the driver closer to the control pedal assembly 10, or to displace the driver further from the control pedal assembly 10, respectively, depending upon the driver's particular physique and preference. To supplement the adjustable feature of the driver's seat, an adjustment unit according to the present invention is secured to the control pedal assembly 10.

As illustrated in FIGS. 1A and 1B, the control pedal assembly 10 generally includes a pedal arm 20 and a pedal foot pad 22. The pedal arm 20 is typically attached to a frame member 14 located beneath the instrument panel (not shown) of the automobile such that the pedal arm 20 is rotatable in a direction away from the driver. The pedal arm 20 is secured to the frame member 14 by a pivot pin 24 which is shown as being retained by a cotter key 26 to prevent the pivot pin 24 from becoming loosened from the frame member 14. It may also be preferable to provide a pivot bushing (not shown) in conjunction with the pivot pin 24 to reduce friction between the pedal arm 20 and the frame member 14.

The pedal arm 20 is typically maintained in a forward position by the biasing effect of a master cylinder pushrod or reaction member 34 which is conventionally biased toward the automobile's passenger compartment by a spring (not shown) within the master cylinder. The pedal arm 20 may also be biased toward the master cylinder pushrod 34 by a suitable helical spring (not shown) so as to maintain positive engagement between the pedal arm 20 and the master cylinder pushrod 34. The master cylinder pushrod 34 reciprocates in its axial direction to actuate a piston (not shown) within the master cylinder for purposes of selectively engaging or disengaging the automobile's brakes or clutch, respectively. Conventionally, the master cylinder pushrod 34 would be rotatably attached directly to the pedal arm 20 with a pivot pin which passes through both the pedal arm 20 and an eyelet 36 located on the end of the master cylinder pushrod 34.

However, as can be seen in FIGS. 1A and 1B, which illustrate the first embodiment of this invention, the pedal arm 20 of the present invention is indirectly actuated by the master cylinder pushrod 34 through a cam 28. The cam 28 is pivotably attached to a pivot link 40 which rotatably interconnects the eyelet 36 of the master cylinder pushrod 34 with the pivot pin 24 of the pedal arm 20. The cam 28 is preferably disc-shaped with a cam contour 30 disposed on an outer surface spaced radially outward from the cam's axis of rotation. As shown in FIG. 1A, the cam contour 30 may constitute essentially the entire perimeter of the cam 28, such that the cam 28 can be rotated as much as 360 degrees while still operating within the range of the cam contour 30. The cam contour 30 is slidably disposed against a camming surface 38 provided on the forward surface of the pedal arm 20. As a result, rotation of the cam 28 causes fore or aft pivoting of the pedal arm 20, depending upon the cam's direction of rotation.

The rate of rotation of the pedal arm 20 is determined in part by the cam contour 30. Depending upon the preferred control parameters with which the pedal arm 20 is to be adjusted relative to the driver's seat, the cam contour 30 can be radially spaced from the cam's axis of rotation so as to cause a constant rate of rotation of the pedal arm 20 given a constant rate of rotation of the cam 28. Alternatively, the cam contour 30 can be shaped to provide a rate of rotation which varies as the pedal arm 20 rotates, providing finer adjustment of the pedal arm 20 where the pedal arm's rate of rotation is lowest.

As noted above, the position of the cam 28 relative to the pedal arm 20 is maintained by being rotatably mounted to the pivot link 40. Preferably, the pivot link 40 is pivotably attached at its upper end to the frame member 14 with the pivot pin 24 so as to extend alongside the pedal arm 20. The lower end of the pivot link 40 is secured to the eyelet 36 of the master cylinder pushrod 34 with a pin 42. As such, the pivot link 40 ensures that the cam 28 will remain positioned to cam against the camming surface 38 of the pedal arm 20. With the biasing effect of the master cylinder pushrod 34, positive contact can be maintained at all times between the cam surface 30 of the cam 28 and the camming surface 38 of the pedal arm 20 to ensure positive mechanical action therebetween. As previously noted, a helical spring (not shown) can also be provided to either act upon the pedal arm 20 to bias the pedal arm 20 against the cam 28, or act through the pivot link 40 to bias the cam 28 against the pedal arm 20. In addition, the pivot link 40 prevents the rotation of the cam 28 from altering the position of the pushrod eyelet 36, and thereby the master cylinder pushrod 34, relative to the master cylinder. Accordingly, any articulation of the master cylinder pushrod 34 is avoided during the adjustment made to the pedal arm 20 by the cam 28.

Figure 7:
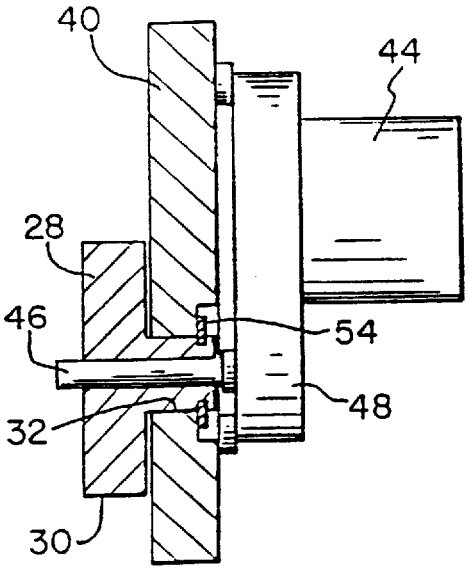
FIG. 7 is a detailed cross-sectional view of the automobile control pedal unit of FIG. 4A in accordance with this invention.

The rotation of the cam 28 is preferably achieved with a drive motor 44 which rotates the cam 28 through a gear box 48 and shaft 46 assembly. Though any suitable type of drive motor 44 can be used, it is preferable in the environment of an automobile's passenger compartment to use an electric drive motor which generates minimal noise. A suitable output speed for the drive motor 44 through the gear box 48 is on the order of about 10 to 12 rpms, though it is foreseeable that different motors could be matched with different gear boxes to produce higher or lower output speeds. As illustrated in FIG. 1A, the drive motor 44 and gear box 48 are attached directly to the pivot link 40 by a pair of threaded fasteners 50. The shaft 46 extends from the gear box 48 through an aperture 32 in the pivot link 40 to the cam 28. A detailed view of this arrangement is illustrated in FIG. 7, which more clearly illustrates the manner in which the cam 28 is pivotably mounted to the pivot link 40, and secured with a clip 54. Consequently, when the shaft 46 is rotated by the drive motor 44, the cam 28 is also rotated about its axis of rotation, causing a corresponding movement of the pedal arm 20 relative to the cam's axis of rotation and the pushrod eyelet 36.

Figure 2B:
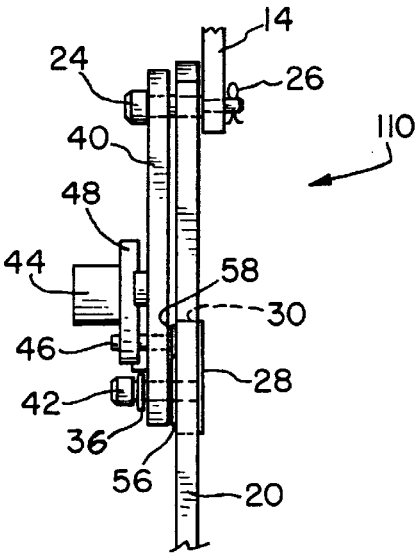
FIG. 2B is a partial view of FIG. 2A in the direction of arrows 2B—2B of FIG. 2A.
Figure 2A:
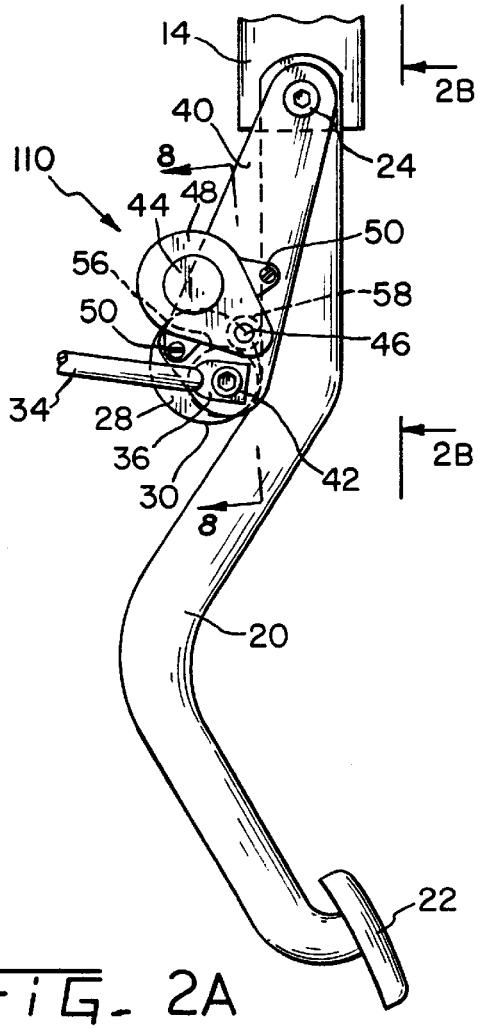
FIG. 2A is a side view of an automobile control pedal unit provided with an adjustment device in accordance with a second embodiment of this invention.
Figure 8:
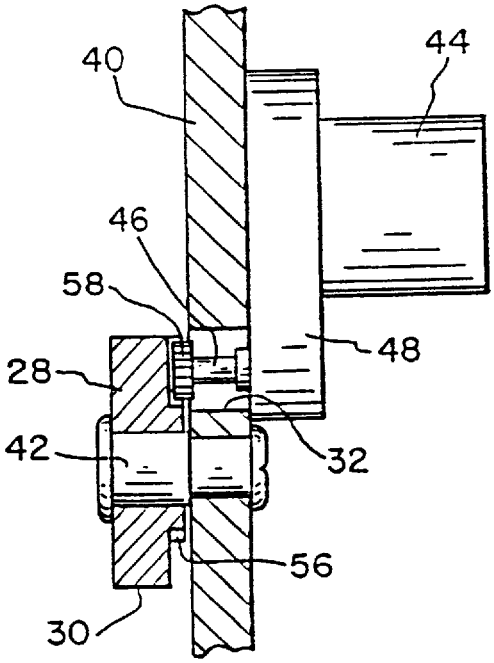
FIG. 8 is a detailed cross-sectional view of the automobile control pedal unit of FIG. 2A taken along arrows 8—8 of FIG. 2A.

FIGS. 2A and 2B illustrate a control pedal assembly 110 in accordance with a second embodiment of this invention, with the same reference numerals representing identical or similar components of FIGS. 1A and 1B, but interconnected in a different manner. Primarily, the embodiment of FIGS. 2A and 2B differs from that of FIGS. 1A and 1B, in that the axis of rotation of the cam 28 coincides with the eyelet 36 of the master cylinder pushrod 34, and the drive motor 44 rotates the cam 28 through a gear 58 mounted to the shaft 46 and in mesh with a gear tooth form 56 provided on the cam 28. A detailed view of this arrangement is illustrated in FIG. 8. Otherwise, the basic characteristics of the control pedal assembly 10 of FIGS. 1A and 1B still apply, with rotation of the cam 28 causing the pedal arm 20 to be rotated toward or away from the eyelet 36 of the master cylinder pushrod 34.

Figure 3A:
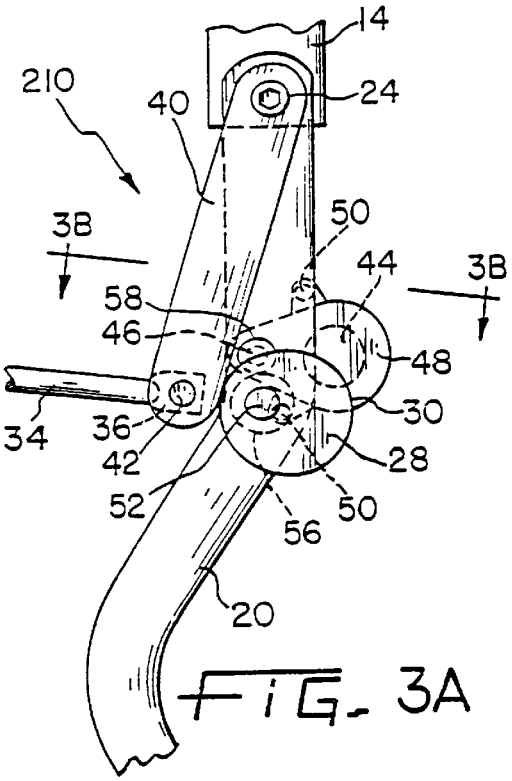
FIG. 3A is a side view of an automobile control pedal unit provided with an adjustment device in accordance with a third embodiment of this invention.
Figure 3B:
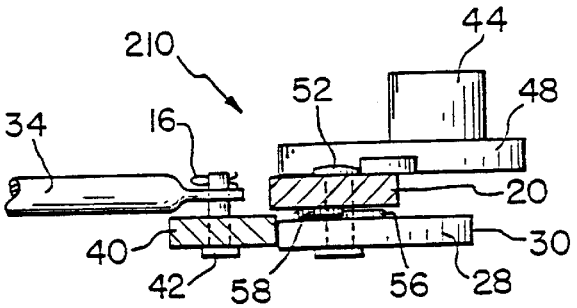
FIG. 3B is a view of FIG. 3A in the direction of arrows 3B—3B of FIG. 3A.

FIGS. 3A and 3B illustrate a control pedal assembly 210 in accordance with a third embodiment of this invention, again with the same reference numerals representing the identical or similar components of FIGS. 1A through 2B, but interconnected in a different manner. Primarily, the embodiment of FIGS. 3A and 3B differs from that of FIGS. 1A and 1B, in that both the cam 28 and the drive motor 44 are mounted to the pedal arm 20, instead of the pivot link 40, with the cam 28 being supported on a pivot pin 52. Also, in a manner essentially identical to that of FIGS. 2A and 2B, the drive motor 44 rotates the cam 28 through the gear 58 mounted to the shaft 46, as represented by FIG. 8.

Figure 4A:
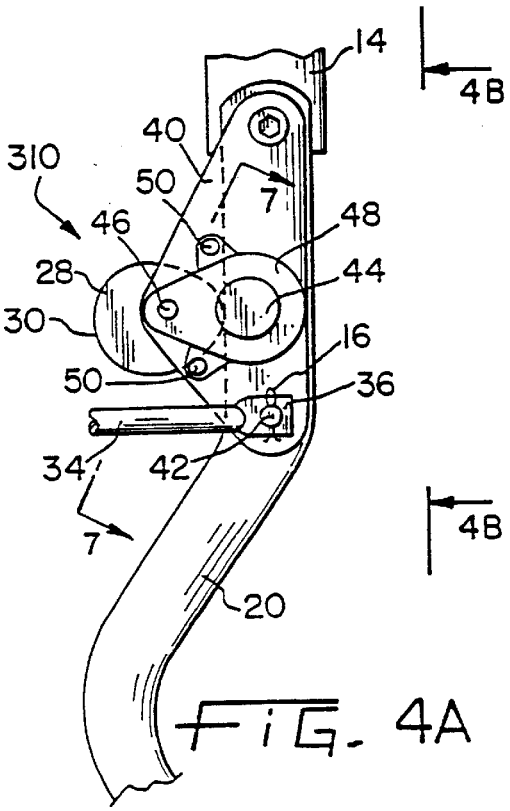
FIG. 4A is a side view of an automobile control pedal unit provided with an adjustment device in accordance with a fourth embodiment of this invention.
Figure 4B:
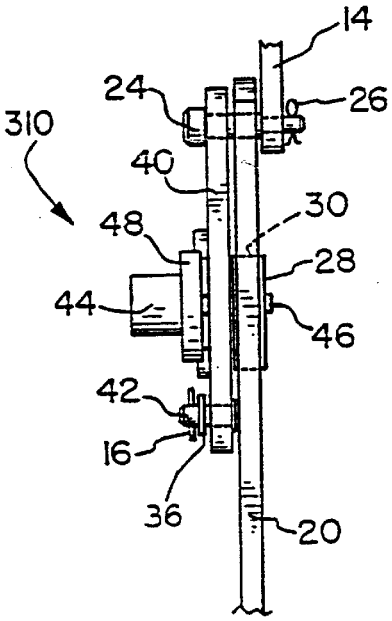
FIG. 4B is a view of FIG. 4A taken in the direction of arrows 4B—4B of FIG. 4A.

A further variation of the control pedal assembly of FIGS. 1A and 1B is illustrated in FIGS. 4A and 4B, representing a control pedal assembly 310 in accordance with a fourth embodiment of this invention. Again, the same reference numerals are used to represent identical or similar components, which are interconnected in a different manner. This embodiment differs from that of FIGS. 1A and 1B by the shape of the pivot link 40, and the position of the drive motor 44 and the cam 28 on the pivot link 40. Shifting the position of the drive motor 44 toward the center of the pivot link 40 allows the pivot link 40 to be aligned substantially parallel with the pedal arm 20, as can be seen in FIG. 4A, such that the control pedal assembly 310 is more compact. In a manner essentially identical to that of FIGS. 1A and 1B, the cam 28 is secured to the shaft 46 as shown in FIG. 7.

With reference to FIGS. 5A through 6B, there is shown an automobile accelerator pedal assembly 60 in accordance with fifth and sixth embodiments of this invention. As illustrated, the accelerator pedal assembly 60 is conventional to the extent that it serves to actuate a cable or reaction member 84 connected to the fuel metering system of an automobile. Similar to the pedal systems of FIGS. 1A through 4B, the accelerator pedal assembly 60 is suspended just above the compartment floor on the driver's side of the automobile. However, an adjustment unit according to the present invention is secured to the accelerator pedal assembly 60 to supplement the adjustable feature of the driver's seat.

Figure 5B:
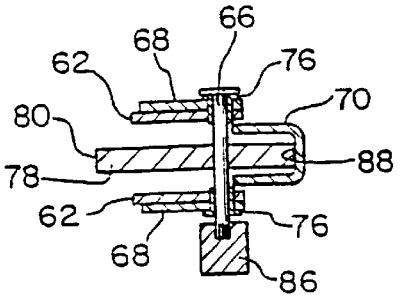
FIG. 5B is a cross-sectional view of FIG. 5A taken along arrows 5B—5B of FIG. 5A.
Figure 5A:
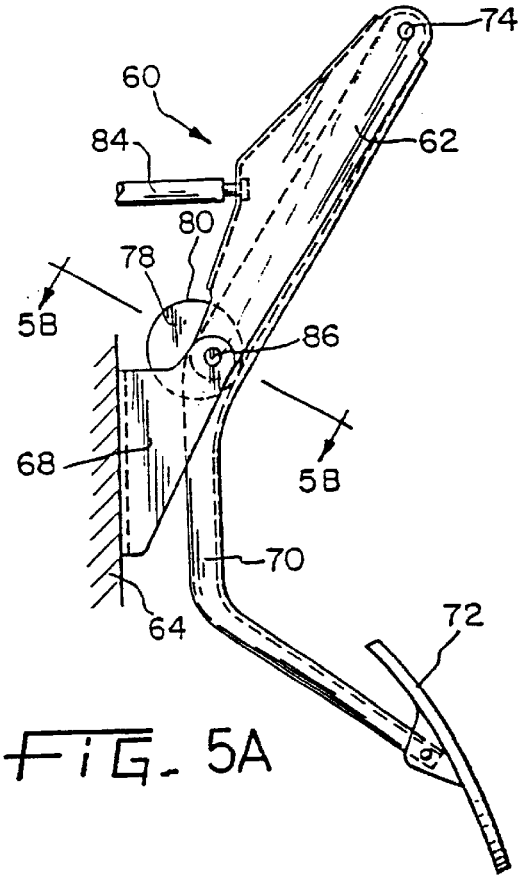
FIG. 5A is a side view of an automobile accelerator pedal unit provided with an adjustment device in accordance with a fifth embodiment of this invention.

As illustrated in FIG. 5A, the accelerator pedal assembly 60 generally includes a pedal arm 70 and a foot pad 72. The pedal arm 70 is pivotably attached with a pin 74 to the upper end of a link 62, to which the accelerator cable 84 is directly attached. The link 62 has a U-shaped cross section, as shown in FIG. 5B, such that the pedal arm 70 can nest within the link 62. The pedal arm 70 also has a U-shaped cross section for added stiffness and strength. The lower end of the link 62 is pivotably attached with a pin 66 to a frame member 68 located beneath the instrument panel of the automobile, such that the link 62 can be pivoted about the pin 66 in order to pull the accelerator cable 84 in a direction toward the driver. As shown in FIG. 5A, the pedal arm 70 is maintained in a forward position with a cam 78 pivotably mounted within the link 62 on the pin 66. Bushings 76 allow the pin 66 to rotate relative to the link 62. The pin 66 is press fit onto the cam 78, such that the cam 78 can be rotated by a drive motor, such as that illustrated in FIGS. 1A through 4B, through a coupling 86. Consequently, the accelerator pedal system 60 can be operated off a drive motor (not shown) which is simultaneously used to adjust the brake and/or clutch pedals. As before, the cam 78 is preferably disc-shaped with a cam contour 80 disposed on an outer surface spaced radially outward from the cam's axis of rotation. The cam contour 80 may constitute essentially the entire perimeter of the cam 78, such that the cam 78 can be rotated as much as 360 degrees while still operating within the range of the cam contour 80. The cam contour 80 is slidably disposed against a camming surface 88 provided on the forward surface of the pedal arm 70, which is biased against the camming contour 80 by any suitable spring or the like (not shown). As a result, rotation of the cam 78 causes fore or aft rotation of the pedal arm 70 about the pin 74, depending upon the cam's direction of rotation.

As a result of the above, the cam 78 also serves as a fulcrum, such that the act of the driver depressing the pedal arm 70 causes the pedal arm 70 and the link 62 to rotate together about the pin 66. As noted before, rotation of the link 62 serves to pull the accelerator cable 84 for the purpose of actuating the automobile's fuel metering system since the accelerator cable 84 is attached to a segment portion 61 of the link 62. However, as can be seen in FIGS. 5A and 5B, the position of the pedal arm 70 can be altered by rotating the cam 78 about the pin 74 in a manner similar to that described in the previous embodiments of this invention.

Figure 6A:
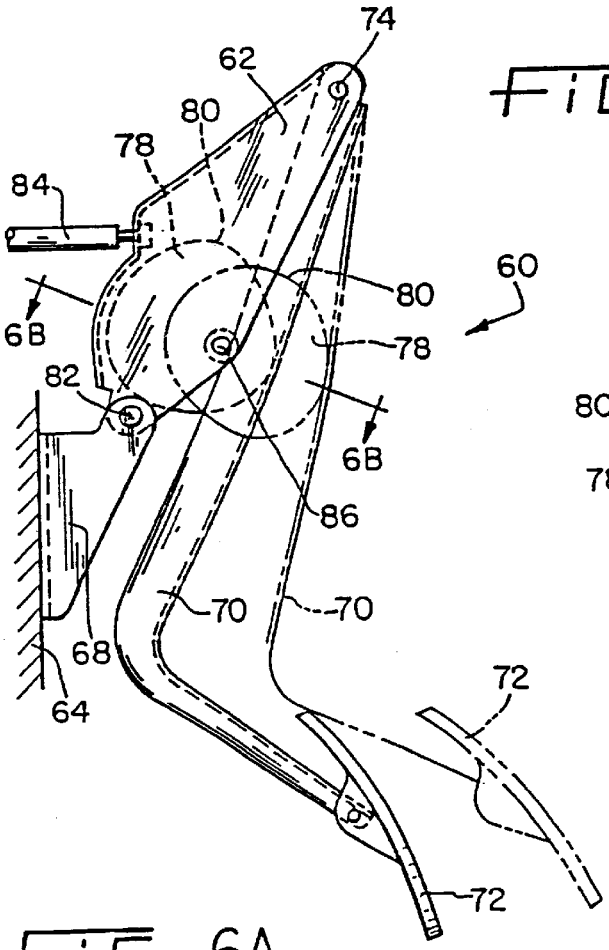
FIG. 6A is a side view of an automobile accelerator pedal unit provided with an adjustment device in accordance with a sixth embodiment of this invention.
Figure 6B:
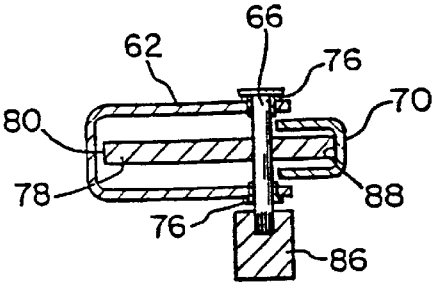
FIG. 6B is a cross-sectional view of FIG. 6A taken along arrows 6B—6B of FIG. 6A.

A final version of the accelerator pedal assembly 60 of this invention is illustrated in FIGS. 6A and 6B. The same reference numerals are used to represent identical or similar components which are interconnected in a different manner. This embodiment differs from that of FIGS. 5A and 5B by the shape of the link 62 and the position of the cam 78 on the link 62. As shown, in lieu of using the same pin 66 on which the cam 78 is supported, a second pin 82 is used to rotatably secure the lower end of the link 62 to the frame member 68. As a result, the forces imposed on the pin 66 are significantly reduced. In addition, the link 62 is modified to more fully enclose the cam 78.

Figure 9A:
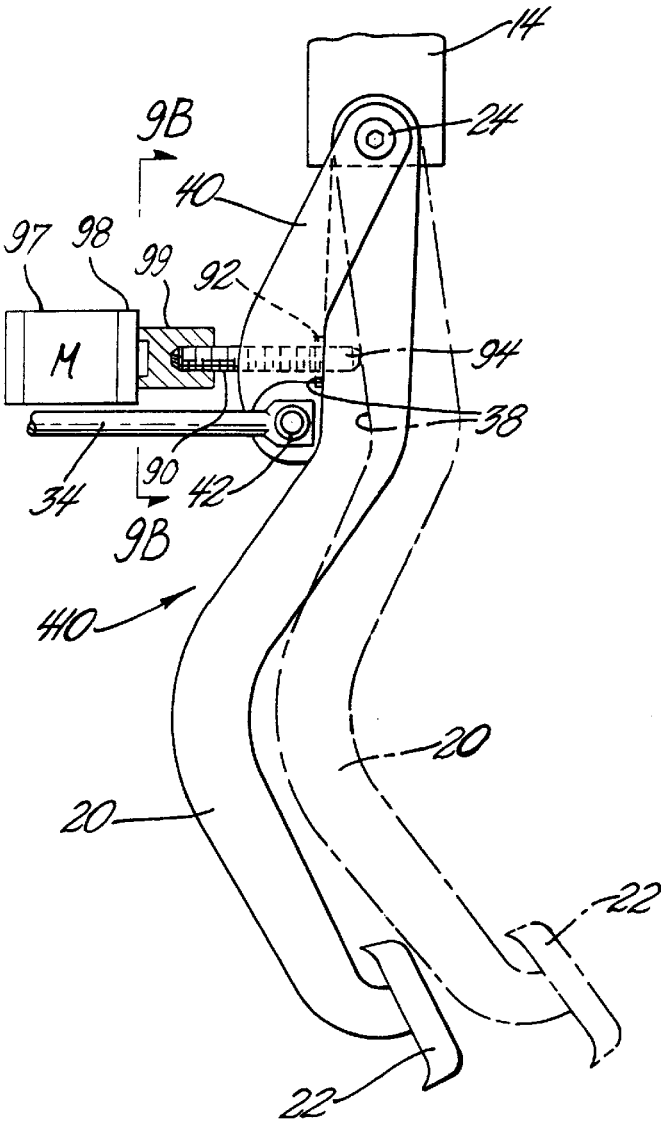
FIG. 9A is a side view of an automobile control pedal unit provided with an adjustment device in accordance with a seventh preferred embodiment of this invention.
Figure 9B:
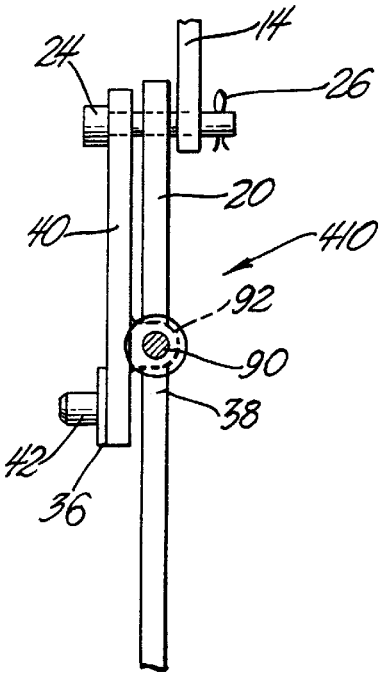
FIG. 9B is a view of FIG. 9A in the direction of arrows 9B—9B of FIG. 9A.
Figure 5B:
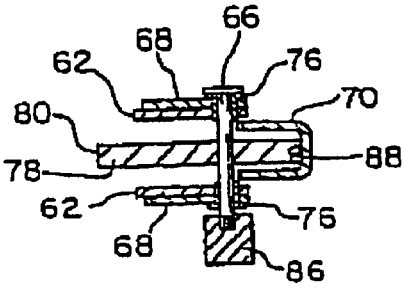
Figure 5A:
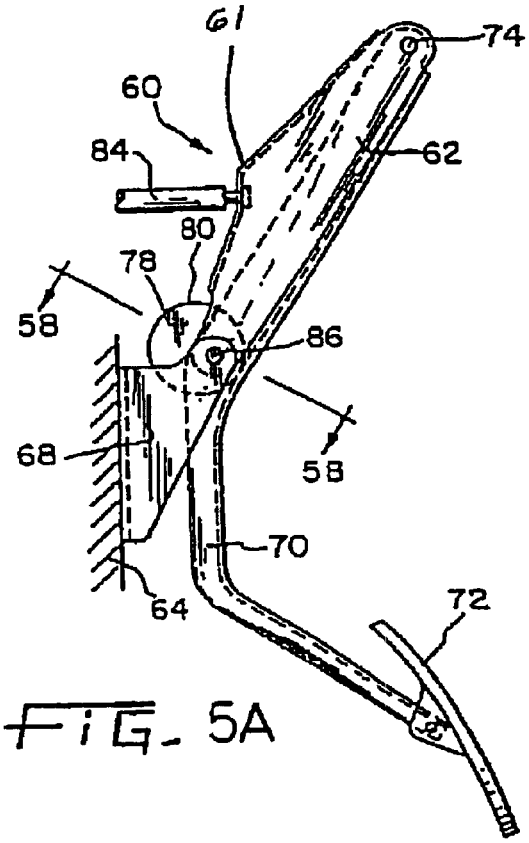
Figure 6A:
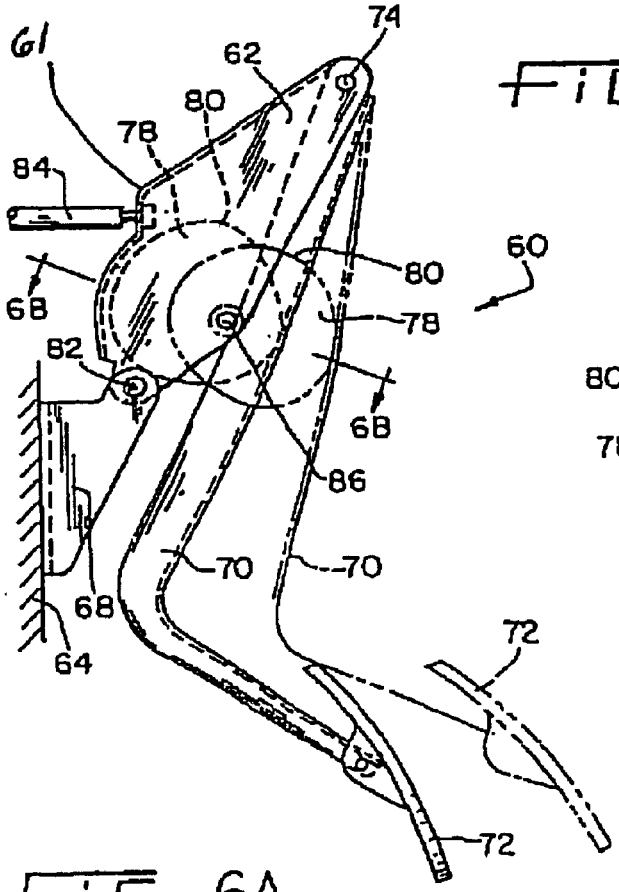
Figure 6B:
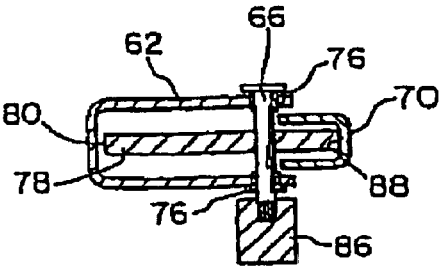

FIGS. 9A and 9B represent a control pedal assembly 410 in accordance with a further preferred embodiment of this invention, again with the same reference numerals representing the identical or similar components of FIGS. 1A through 4B. However, in this embodiment, the function of the cams 28 and shafts 46 of FIGS. 1A through 4B are performed by a power screw 90. As shown, the power screw 90 is threadably received in an internally threaded boss 92 formed on or secured to the pivot link 40. One end 94 of the power screw 90 abuts the camming surface 38 provided on the forward surface of the pedal arm 20. As a result, rotation of the power screw 90 causes fore or aft pivoting of the pedal arm 20, depending upon the power screw's direction of rotation. The power screw 90 can be driven in any suitable manner such as by a drive motor 97 connected to the end of the power screw 90 through a coupling 99 or a manually actuated cable (not shown). A gear driver reduction insert 98 is also contemplated. As is apparent from the above description, an advantage of the embodiment shown in FIGS. 9A and 9B is the simplification of the mechanism which pivots the pedal arm 20.

From the above, it can be seen that a significant advantage of the adjustment devices of this invention is that by selectively energizing a drive motor, a cam can be used to select an optimal fore or aft position of one or more automobile control pedal arms relative to the needs of the driver. Consequently, not only can the driver adjust the driver's seat to position himself or herself relative to the automobile's control pedals, but the driver can also adjust the position of the control pedals such that they are positioned to provide optimal comfort to the driver. The use of this invention may result in significant simplification of the seat adjuster mechanisms or telescoping steering wheel mechanism since the function of providing adjustment of the seat to enable reaching of the pedals need no longer be considered.

In addition, where all of the automobile's control pedals—namely, the brake, clutch and accelerator pedals—are provided with the adjustment device of the present invention, each control pedal can be adjusted individually or collectively so as to provide optimal positioning of the control pedals for the particular physique of the driver. The control pedals can be independently adjusted with individual drive motors, or a single drive motor can be coupled with each pedal, such that all of the pedals are simultaneously adjusted according to a single command initiated by the driver. With either approach, the controls for the drive motor, and thus the adjustment of each control pedal assembly, can be located to be accessible to the driver, such as on the automobile's instrument panel.

Another advantage is that the adjustment devices of this invention require minimal additional hardware and can be readily adapted to a conventional control pedal without the need to relocate the brake cylinder pushrod or accelerator cable from its current position. Accordingly, excessive space beneath the instrument panel is not required to accommodate the adjustment devices, nor is there a significant penalty in terms of added weight.

While the invention has been described in terms of certain preferred embodiments, it is apparent that other forms could be adopted by one skilled in the art. For example, other means for rotating the cams 28 and 78 could be readily adopted by those skilled in the art to achieve the adjustment of the control pedals as described, and various other components or structures could be employed in lieu of the links 40 and 62. Accordingly, the scope of the invention is to be limited only by the following claims.

What is claimed is:

1. An adjustment device for adjusting a pedal arm with respect to a datum point on a reaction member, said pedal arm being rotatable about an axis of arm rotation, said adjustment device comprising:

a link member having a first pivot axis in one end and a second pivot axis in an oppositely disposed other end, said one end of said link member mounted juxtaposed said pedal arm about said axis of arm rotation; and means, rotatably mounted to one of said pedal arm and said link member, for rotating said pedal arm about said axis of arm rotation, said rotating means having an axis of rotation complementary with one of said pedal arm and said link member and spaced a predetermined distance from said axis of arm rotation, said predetermined distance being no greater than the distance between said first pivot axis and said second pivot axis, said rotating means further comprising:

a rotatable member mounted about said axis of rotation, said rotatable member having one portion mounted to one of said pedal arm and said link member and another peripheral portion extending in a direction towards the other of said pedal arm and said link member so as to make contact therewith;

means for mounting said rotatable member to said one of said pedal arm and said link member; and drive means interconnected with said rotatable member for rotating said rotatable member about said axis of rotation whereby as said drive means rotates said rotatable member said pedal arm is rotated about said axis of arm rotation; and means for mounting said datum point of said reaction member to said link member, said mounting means being located on said link member interposed said first pivot axis and said second pivot axis of said link member.

2. The adjustment device of claim 1 further comprising:

a frame member; and wherein said one end of said link member is pivotably attached to said frame member about said first pivot axis; and further wherein said other end of said link member is pivotably attached to said reaction member so as to define said second pivot axis.

3. The adjustment device of claim 2 wherein said axis of rotation is spaced a predetermined distance from said second pivot axis defined by said reaction member and said other end of said link member.

4. The adjustment device of claim 1 wherein said means for rotating said pedal arm is a power screw rotatably mounted to one of said link member and said pedal arm.

5. The adjustment device as claimed in claim 1 wherein said link member further comprises:

a segment portion connected to said reaction member; and means for securing said reaction member to said link member at said segment portion.

6. The adjustment device as claimed in claim 5 wherein said drive means further comprises:

a drive housing having a drive motor located in said drive housing and gear box means mounted in said drive housing complementary with said drive motor, said gear box means having a projecting portion extending in a direction towards said rotatable member and engaging said rotatable member to establish a driving relationship therewith, said gear box means rotating said rotatable member in one direction when said drive motor is driven in a first direction and further rotating said rotatable member in a second opposite direction when said drive motor is driven in a second opposite direction such that as said rotatable member rotates said pedal arm is pivoted about said axis of arm rotation.

7. The adjustment device as claimed in claim 5 wherein said segment portion of said link member is said opposite other end of said link member.

8. The adjustment device of claim 1 wherein said means for rotating said pedal arm about said axis of arm rotation comprises camming means rotatably mounted to one of said pedal arm and said link member said camming means having an axis of cam rotation.

9. The adjustment device of claim 8 wherein said camming means is rotatably mounted to one of said pedal arm and said link member such that said camming means cams against the other of said pedal arm and said link member to rotate said pedal arm about said axis of arm rotation and said drive means is mounted to the other of said pedal arm and said link member so as to rotate said camming means about said axis of cam rotation.

10. The adjustment device of claim 9 wherein the other end of said link member defines a pivot axis, said reaction member being attached to said pivot axis for pivoting movement therewith, and further wherein said axis of cam rotation is a predetermined distance from said pivot axis defined by said link member.

11. The adjustment device of claim 9 wherein the other end of said link member defines a pivot axis, said reaction member being attached to said pivot axis for pivoting movement therewith, said axis of cam rotation coinciding with said pivot axis defined by said link member.

12. The adjustment device of claim 8 wherein said camming means is rotatably mounted to said pedal arm such that said camming means cams against said link member to rotate said pedal arm about said axis of arm rotation and said drive means is mounted to said pedal arm and interconnected with said camming means so as to rotate said camming means about said axis of cam rotation.

13. The adjustment device of claim 8 wherein said camming means is rotatably mounted to said link member such that said camming means cams against said pedal arm to rotate said pedal arm about said axis of arm rotation and said drive means is mounted remote from said link member and interconnected with said camming means so as to rotate said camming means about said axis of cam rotation.

14. The adjustment device of claim 8 wherein said drive means further comprises an extended portion having a drive shaft interconnecting said drive means with said camming means for rotating said camming means about said axis of cam rotation.

15. The adjustment device of claim 8 wherein said drive means further comprises a drive motor and a gear box interconnecting said drive motor with said camming means.

16. The adjustment device of claim 9 wherein said drive means further comprises an extended portion having a drive shaft interconnecting said drive means with said camming means for rotating said camming means about said axis of cam rotation.

17. The adjustment device of claim 14 wherein said extended portion of said drive means further comprises a pinion gear secured to said drive shaft and wherein said camming means further comprises a gear tooth form in mesh with said pinion gear for rotating said camming means about said axis of cam rotation.

18. The adjustment device of claim 9 wherein said drive means further comprises a drive motor and a gear box interconnecting said drive motor with said camming means.

19. The adjustment device of claim 10 wherein said drive means further comprises an extended portion having a drive shaft interconnecting said drive means with said camming means for rotating said camming means about said axis of cam rotation.

20. The adjustment device of claim 16 wherein said extended portion of said drive means further comprises a pinion gear secured to said drive shaft and wherein said camming means further comprises a gear tooth form in mesh with said pinion gear for rotating said camming means about said axis of cam rotation.

21. The adjustment device of claim 14 wherein said drive means comprises a drive motor and a gear box interconnecting said drive motor with said extended portion of said drive means.

22. The adjustment device of claim 1 wherein said axis of rotation coincides with said second pivot axis of said link member.

23. The adjustment device of claim 8 wherein said drive means is mounted remote from said camming means and wherein said camming means comprises a coupling for interconnecting said camming means with said drive means.

24. The adjustment device of claim 1 further comprising:

a frame member; and wherein one of said first pivot axis and second pivot axis of said link member is pivotably attached to said frame member and pivotably mounted substantially concentric with said axis of arm rotation; and the other of said first pivot axis and second pivot axis of said link member is pivotably attached to said reaction member.

25. The adjustment device of claim 1 wherein said axis of rotation is substantially parallel to said axis of arm rotation.

26. The adjustment device of claim 8 wherein said camming means is a disc having a camming surface radially spaced from said axis of cam rotation, said camming surface slidably contacting one of said pedal arm and link member.

27. The adjustment device as claimed in claim 8 wherein said reaction member has one end secured to said link member and wherein said link member further comprises a segment portion connected to said reaction member and means for securing said reaction member to said link member.

28. The adjustment device as claimed in claim 8 wherein said camming means is a cam member mounted to said link member, said cam member further comprising:

a cam surface juxtaposed said pedal arm;

means for mounting said cam member to said link member; and further wherein said drive means is mounted to said link member, said drive means further comprising;

a drive housing mounted to said link member;

a drive motor located in said drive housing; and gear box means mounted in said drive housing complementary with said drive motor, said gear box means having a projecting portion extending in a direction towards said cam member and engaging said cam member to establish a driving relationship therewith, said gear box means rotating said cam member in one direction when said drive motor is driven in a first direction and further rotating said cam member in a second opposite direction when said drive motor is driven in a second opposite direction such that as said cam member rotates said pedal arm is pivoted about said axis of arm rotation.

29. The adjustment device as claimed in claim 27 wherein said segment portion of said link member comprises an opposite end of said link member having an aperture defining said second pivot axis centrally disposed with said aperture, said second pivot axis of said opposite end of said link member being coaxial with said axis of cam rotation.

30. The adjustment device as claim in claim 27 wherein said segment portion of said link member comprises an opposite end of said link member having an aperture defining a reaction pivot axis centrally disposed with said aperture, and further wherein said axis of rotation is located between said second pivot axis and said axis of arm rotation.

31. The adjustment device as claimed in claim 27 wherein said camming means is a cam member mounted to said pedal arm, said cam member further comprising a cam surface juxtaposed said link member; and wherein said drive means comprises:

a drive housing mounted to said pedal arm;

a drive motor located in said drive housing;

gear box means mounted in said drive housing complementary with said drive motor, said gear box means having a projecting portion extending in a direction towards said cam member and engaging said cam member to establish a driving relationship therewith, said gear box means rotating said cam member in one direction when said drive motor is driven in a first direction and further rotating said cam member in a second opposite direction when said drive motor is driven in a second opposite direction such that as said cam member rotates said pedal arm is pivoted about said axis of arm rotation; and means for mounting said drive means to said pedal arm.

32. The adjustment device as claimed in claim 27 wherein said camming means is a cam member mounted to said pedal arm, said cam member further comprising a cam surface juxtaposed said reaction member; and wherein said drive means further comprises:

drive housing mounted to said pedal arm;

a drive motor located in said drive housing;

gear box means mounted in said drive housing complementary with said drive motor, said gear box means having a projecting portion extending in a direction towards said cam member and engaging said cam member to establish a driving relationship therewith, said gear box means rotating said cam member in one direction when said drive motor is driven in a first direction and further rotating said cam member in a second opposite direction when said drive motor is driven in a second opposite direction such that as said cam member rotates said pedal arm is pivoted about said axis of arm rotation; and means for mounting said drive means to said pedal arm.

33. The adjustment device as claimed in claim 9 wherein said link member further comprises an opposite end portion having an aperture defining said second pivot axis, said second pivot axis of said opposite end portion of said link member being coaxial with said axis of cam rotation.

34. The adjustment device as claimed in claim 33 wherein said drive means is remotely located with respect to said camming means and further wherein said camming means is a cam member mounted to said link member and having a cam surface radially spaced from said axis of cam rotation, said cam surface being juxtaposed said pedal arm; and further wherein said drive means comprises a projecting portion extending in a direction towards said cam member and is fixedly secured thereto such that as said drive means and associated projecting portion is rotated in a first direction said cam member rotates in said first direction, said drive means and associated projecting portion rotating said cam member in a second opposite direction when said drive means rotates in a second opposite direction.

35. The adjustment device of claim 8 wherein said rotatable member comprises a disc having a camming surface radially spaced from said axis of cam rotation, said disc having one end pivotably connected to said pedal arm at said axis of arm rotation and an opposite end pivotably connected to said disc at said axis of cam rotation.

36. An adjustment device for adjusting a pedal arm with respect to a datum point on a reaction member, said pedal arm being rotatable about an axis of arm rotation, said adjustment device comprising:

a link member having a first pivot axis in one end and a second pivot axis in an oppositely disposed other end, said one end of said link member mounted juxtaposed said pedal arm about said axis of arm rotation;

thread means mounted to one of said pedal arm and said link member for rotating said pedal arm about said axis of arm rotation, said thread means having an axis of rotation spaced a predetermined distance from said axis of arm rotation;

means for mounting said thread means to said one of said pedal arm and said link member;

drive means interconnected with said thread means for rotating said thread means about said axis of rotation whereby as said drive means rotates said thread means said pedal arm is rotated about said axis of arm rotation.

37. The adjustment device as claimed in claim 36 further comprising means for mounting said datum point of said reaction member to said link member.

38. The adjustment device as claimed in claim 36 wherein said thread means for rotating said pedal arm is a power screw rotatably mounted to one of said link member and said pedal arm.

39. The adjustment device as claimed in claim 36 wherein said link member further comprises a portion connected to said reaction member; and means for securing said reaction member to said link member.

40. The adjustment device as claimed in claim 36 wherein said drive means further comprises:

a drive housing having a drive motor located in said drive housing and gear box means mounted in said drive housing complementary with said drive motor, said gear box means engaging said thread means to establish a driving relationship therewith, said gear box means rotating said thread means in one direction when said drive motor is driven in a first direction and further rotating said thread means in a second opposite direction such that as said thread means rotates said pedal arm is pivoted about said axis of arm rotation.

41. The adjustment device as claimed in claim 38 wherein said drive means further comprises:

a drive housing having a drive motor located in said drive housing and gear box means mounted in said drive housing complementary with said drive motor, said gear box means engaging said power screw to establish a driving relationship therewith, said gear box means rotating said power screw in one direction when said drive motor is driven in a first direction and further rotating said power screw in a second opposite direction such that as said power screw rotates said pedal arm is pivoted about said axis of arm rotation.

* * * * *

UNITED STATES PATENT AND TRADEMARK OFFICE

CERTIFICATE OF CORRECTION

PATENT NO. : 5,771,752
DATED : June 30, 1998
INVENTOR(S) : Edmond B. Cicotte

It is certified that error appears in the above-identified patent and that said Letters Patent is hereby corrected as shown below:

Column 1, line 59, kindly delete "2,550,731" second occurrence, and insert ---- 2,550,732----.

Column 6, line 32, after "4A" kindly insert ---- taken along arrows 7-7 of Fig. 4A ----.

Column 6, line 39, after "invention;" kindly insert ---- and ----.

Column 12, line 26, after "member" kindly insert a comma ---- , ----.

Column 13, line 65, after "comprising" kindly delete the semi-colon " ; " and insert a colon ---- : ----.

Column 14, line 51, prior to "drive" kindly insert ---- a ----.

UNITED STATES PATENT AND TRADEMARK OFFICE

CERTIFICATE OF CORRECTION

PATENT NO. : 5,771,752

DATED : June 30,1998

INVENTOR(S) : Edmond B. Cicotte

It is certified that error appears in the above-identified patent and that said Letters Patent is hereby corrected as shown below:

Column 15, line 39, after "member;" kindly insert ---- and ----.

Signed and Sealed this

Thirteenth Day of July, 1999

*Attest:*

*Attesting Officer*

Q. TODD DICKINSON

*Acting Commissioner of Patents and Trademarks*

US005771752C1

(12) EX PARTE REEXAMINATION CERTIFICATE (5764th)

United States Patent
Cicotte

(10) Number: US 5,771,752 C1
(45) Certificate Issued: May 15, 2007

(54) ADJUSTABLE AUTOMOBILE PEDAL SYSTEM

(76) Inventor: Edmond B. Cicotte, 11086 Hedgeway, Utica, MI (US) 48317

Reexamination Request:
No. 90/005,749, Jun. 15, 2000

Reexamination Certificate for:

| | |
|---|---|
| Patent No.: | **5,771,752** |
| Issued: | **Jun. 30, 1998** |
| Appl. No.: | **08/730,573** |
| Filed: | **Oct. 15, 1996** |

Certificate of Correction issued Jul. 13, 1999.

Related U.S. Application Data

(63) Continuation of application No. 08/266,937, filed on Aug. 16, 1994, now abandoned, which is a continuation-in-part of application No. 07/772,326, filed on Oct. 7, 1991, now Pat. No. 5,351,573.

(51) Int. Cl.
*G05G 1/14* (2006.01)

(52) U.S. Cl. ..... 74/512; 74/513; 74/518; 74/560

(58) Field of Classification Search ..... None
See application file for complete search history.

(56) References Cited

U.S. PATENT DOCUMENTS

| | | | | |
|---|---|---|---|---|
| 1,454,258 | A | | 5/1923 | Adams |
| 1,902,094 | A | | 3/1933 | Page, Jr. |
| 2,379,774 | A | | 7/1945 | Wyer |
| 2,620,042 | A | | 12/1952 | Vincent |
| 2,621,538 | A | | 12/1952 | Bechman |
| 2,992,797 | A | | 7/1961 | Visser |
| 3,511,109 | A | | 5/1970 | Tanaka |
| 3,631,739 | A | | 1/1972 | McArthur |
| 3,643,524 | A | | 2/1972 | Herring |
| 3,653,111 | A | | 4/1972 | Bruce |
| 3,691,868 | A | | 9/1972 | Smith |
| 3,754,480 | A | | 8/1973 | Bodnar |
| 3,828,625 | A | | 8/1974 | Bruhn, Jr. |
| 3,942,816 | A | | 3/1976 | Scherenberg |
| 3,944,012 | A | * | 3/1976 | La Chiusa ..... 180/77 R |
| 3,954,041 | A | | 5/1976 | Mechulam |
| 3,975,972 | A | | 8/1976 | Muhleck |
| 3,990,715 | A | | 11/1976 | Shimada |
| 4,047,145 | A | | 9/1977 | Schwehr |
| 4,120,387 | A | | 10/1978 | Otteblad |
| 4,134,560 | A | | 1/1979 | Messerschmidt |

(Continued)

FOREIGN PATENT DOCUMENTS

| | | |
|---|---|---|
| DE | P.A.276895 | 5/1968 |
| DE | 22 47 963 | 7/1975 |
| DE | 4122629 | 1/1993 |

(Continued)

OTHER PUBLICATIONS

Translation of Japanese Unexamined Utility Model Patent Publication No. 51–22218 from PTO Scientific Library.*

(Continued)

*Primary Examiner*—Vinh T. Luong

(57) ABSTRACT

An adjustment device for an automobile control pedal which is capable of pivotably adjusting the control pedal relative to a reaction member, such as the eyelet of a cylinder pushrod for a brake pedal or a flexible cable in case of an accelerator pedal. The adjustment device allows the control pedal to be positioned to suit the needs of a particular driver. The control pedal can be pivotably attached to a frame in any conventional manner, such as with a pivot pin. The adjustment device is mounted alongside the control pedal and to the pushrod eyelet without the need of additional support hardware other than a device for acting on the control pedal. The adjustment device includes a rotatable member for causing pivotable movement of the pedal arm relative to the reaction member. The adjustment device is maintained a predetermined distance from the pivot of the control pedal arm by a spacing device, such as a link. The adjustment device also includes a rotatable driving device for rotating about its axis of rotation to produce a corresponding displacement of the control pedal arm.

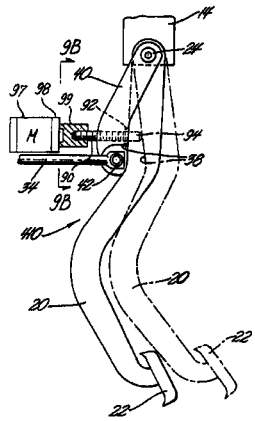

U.S. PATENT DOCUMENTS

| | | | | |
|---|---|---|---|---|
| 4,237,752 | A | 12/1980 | Hildebrecht | |
| 4,327,414 | A | 4/1982 | Klein | |
| 4,385,528 | A | 5/1983 | Pauwels | |
| 4,470,570 | A | 9/1984 | Sakurai | |
| 4,497,399 | A | 2/1985 | Kopich | |
| 4,505,151 | A | 3/1985 | Sauerschell et al. | |
| 4,528,590 | A | 7/1985 | Bisacquino | |
| 4,779,481 | A | * 10/1988 | Natzke et al. | 74/512 |
| 4,799,848 | A | 1/1989 | Buckley | |
| 4,831,985 | A | 5/1989 | Mabee | |
| 4,848,708 | A | 7/1989 | Farrell | |
| 4,875,385 | A | * 10/1989 | Sitrin | 74/512 |
| 4,883,037 | A | 11/1989 | Mabee | |
| 4,899,614 | A | 2/1990 | Kataumi | |
| 4,915,075 | A | 4/1990 | Brown | |
| 4,938,304 | A | 7/1990 | Yamaguchi | |
| 4,944,269 | A | 7/1990 | Imoehl | |
| 4,958,607 | A | 9/1990 | Lundberg | |
| 4,969,437 | A | 11/1990 | Kolb | |
| 5,086,663 | A | 2/1992 | Asano et al. | |

FOREIGN PATENT DOCUMENTS

| | | |
|---|---|---|
| DE | 41 22 629 A1 | 1/1993 |
| DE | 42 43 373 A1 | 6/1993 |
| EP | 0 139 082 | 5/1984 |
| EP | 0256466 | 2/1988 |
| EP | 0 420 829 B1 | 1/1993 |
| GB | 920784 | 3/1963 |
| JP | 63-004312 | 1/1969 |
| JP | 51-22218 | 2/1976 |
| JP | 56-086827 | 7/1981 |
| JP | 58-97629 | 7/1983 |
| JP | 63-004313 | 1/1988 |
| JP | 63-49528 | 2/1988 |
| JP | 64-060479 | 3/1989 |
| JP | 64-070238 | 3/1989 |
| JP | 2039214 | 2/1990 |
| JP | 2039217 | 2/1990 |
| JP | 2116911 | 5/1990 |
| JP | 2129710 | 5/1990 |
| JP | 4-504328 | 7/1990 |
| JP | 3042336 | 2/1991 |
| JP | 4-505063 | 2/1991 |
| JP | 04-125712 | 4/1992 |
| JP | 4-255012 | 9/1992 |
| JP | 07-096784 | 4/1995 |
| JP | 7-334262 | 12/1995 |

OTHER PUBLICATIONS

Phillips, Edward H., Delta Fins, Simplified Systems Increase Learjet 55C Reliability, Aviation Week & Space Technology, Oct. 31, 1989, pp. 1–2.

GM Pontiac 1974 Service Manual, pp. 1–7.

GM 1975 Pontiac Service Manual, pp. 1–6.

Smith, Ronald A., Electronic Accelerator Pedal Assemblies and Environmental Considerations, pp. 1–10.

Evolution in Braking, Automotive Engineering, Aug. 1992, p. 1–2.

New Approaches to Electronic Throttle Control, SAE Technical Papers Series 910085, Feb. 25–Mar. 1, 1991, pp. 1–11.

U.S. Appl. No. 09/309,526, filed May 11, 1999, Willemsen.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 7, lines 3–15:

As illustrated in FIGS. 1A and 1B, the control pedal assembly 10 generally includes a pedal arm 20 and a pedal foot pad 22. The pedal arm 20 is typically attached to a frame member 14 located beneath the instrument panel (not shown) of the automobile such that the pedal arm 20 is rotatable in a direction away from the driver. The pedal arm 20 is secured to the frame member 14 by a pivot pin 24 which is shown as being retained by a cotter key 26 to prevent the pivot pin 24 from becoming loosened from the frame member 14. It may also be preferable to provide a pivot bushing (not shown) in conjunction with the pivot pin 24 to reduce friction between the pedal arm 20 and the frame member 14. *Pivot pin 24 defines an axis of arm rotation.*

Column 10, lines 7–18:

A final version of the accelerator pedal assembly 60 of this invention is illustrated in FIGS. 6A and 6B. The same reference numerals are used to represent identical or similar components which are interconnected in a different manner. This embodiment differs from that of FIGS. 5A and 5B by the shape of the link 62 and the position of the cam 78 on the link 62. As shown, in lieu of using the same pin 66 on which the cam 78 is supported, a second pin 82 is used to rotatably secure the lower end of the link 62 to the frame member 68 *about a link second pivot axis*. As a result, the forces imposed on the pin 66 are significantly reduced. In addition, the link 62 is modified to more fully enlcose the cam 78.

THE DRAWING FIGURES HAVE BEEN CHANGED AS FOLLOWS:

Add referential numeral 61 in FIGS. 5A and 6A.

AS A RESULT OF REEXAMINATION, IT HAS BEEN DETERMINED THAT:

The patentability of claims 6, 8–23 and 25–35 is confirmed.

Claims 1–5, 7, 24 and 36–41 are cancelled.

New claims 42–53 are added and determined to be patentable.

*42. An adjustable pedal assembly for an automobile to accommodate drivers of varying height, the adjustable pedal assembly comprising:*

*an elongate pedal arm having a pedal pad at one end and an axis of arm rotation formed at the opposite end thereof, said pedal arm being rotatable about the axis of arm rotation;*

*an elongate link member having a first pivot axis in one end and a second pivot axis in an oppositely disposed other end, one end of the link member mounted in adjacent juxtaposed relation to said pedal arm with the link first pivot axis aligned coaxially with said axis of arm rotation and generally perpendicular to the elongate link;*

*a screw and associated annular threaded member rotatably mounted to one of said pedal arm and said link member and drivingly cooperating with the other of said pedal arm and link member in order to rotate the pedal arm about the axis of arm rotation, the screw and associated annular threaded member having a screw axis of rotation complementary with one of said pedal arm and said link member and spaced a predetermined distance from said axis of arm rotation, said predetermined distance being no greater than the distance between the link first and second pivot axes, the screw and associated annular threaded member having means for mounting one of the screw and associated annular threaded member to one of said pedal arm and said link member enabling relative rotation about the screw axis of rotation, with the other of the screw and associated annular threaded member having a peripheral portion extending in a direction toward and engaging the other of said pedal arm and said link member so as to make contact therewith to pivot the pedal and link away and toward each other about the axis of arm rotation;*

*an electric motor rotatably driving the screw and associated annular threaded member relative to one another about the screw axis of rotation whereby operation of the electric motor rotates the pedal arm about the axis of arm rotation varying the position of the pedal pad; and*

*means for mounting a datum point of a reaction member to said link member interposed the link first and second pivot axis.*

*43. The adjustable pedal assembly of claim 42 further comprising a frame member adapted to be affixed to an automobile, the frame member being pivotably connected to the link about one of the link pivot axes to enable a subassembly formed by the link, pedal arm and screw and associated annular threaded member to rotate relative to the frame member when the driver depresses the pedal pad.*

*44. The adjustable pedal assembly of claim 43 wherein the link rotates relative to the frame member about the link first pivot axis.*

*45. The adjustable pedal assembly of claim 44 wherein the reaction member controls the automobile brakes.*

*46. The adjustable pedal assembly of claim 43 wherein the link rotates relative to the frame member about the link second pivot axis.*

*47. The adjustable pedal assembly of claim 46 wherein the reaction member controls the automobile accelerator.*

*48. An adjustable pedal assembly for an automobile for accommodating drivers of varying height, the adjustable pedal assembly comprising:*

*an elongate pedal arm having a pedal pad at one end and an axis of arm rotation formed at the opposite end thereof, said pedal arm being rotatable about the axis of arm rotation;*

*an elongate link member having a first pivot axis in one end and a second pivot axis in an oppositely disposed other end, one end of the link member mounted in adjacent juxtaposed relation to said pedal arm with a*

*link pivot axis aligned coaxially with said axis of arm rotation and generally perpendicular to the elongate link;*

*a screw and associated annular threaded member rotatably mounted to one of said pedal arm and said link member and drivingly cooperating with the other of said pedal arm and link member in order to rotate the pedal arm about the axis of arm rotation, the screw and associated annular threaded member having a screw axis of rotation complementary with one of said pedal arm and said link member and spaced a predetermined distance from said axis of arm rotation, said predetermined distance being no greater than the distance between the link first and second pivot axes, the screw and associated annular threaded member having means for mounting one of the screw and associated annular threaded member to one of said pedal arm and said link member enabling relative rotation about the screw axis of rotation, with the other of the screw and associated annular threaded member having a peripheral portion extending in a direction toward and engaging the other of said pedal arm and said link member so as to make contact therewith to pivot the pedal and link away and toward each other about the axis of arm rotation; and*

*an electric motor rotatably driving the screw and associated annular threaded member relative to one another about the screw axis of rotation, whereby operation of the electric motor rotates the pedal arm about the axis of arm rotation varying the position of the pedal pad relative to a datum point on a reaction member operated by the pedal assembly enabling the driver to control the automobile.*

*49. The adjustable pedal assembly of claim 48 further comprising a frame member adapted to be affixed to an automobile, the frame member being pivotably connected to the link about one of the link pivot axes to enable a subassembly formed by the link, pedal arm and screw and associated annular threaded member to rotate relative to the frame member when the driver depresses the pedal pad.*

*50. The adjustable pedal assembly of claim 48 wherein the link rotates relative to the frame member about the link first pivot axis.*

*51. The adjustable pedal assembly of claim 50 wherein the reaction member controls an automobile brake.*

*52. The adjustable pedal assembly of claim 48 wherein the link rotates relative to the frame member about the link second pivot axis.*

*53. The adjustable pedal assembly of claim 48 wherein the reaction member controls an automobile accelerator.*

* * * * *